US005291623A

United States Patent [19]

Artz

[11] Patent Number: 5,291,623

[45] Date of Patent: Mar. 8, 1994

[54] INFLATABLE CRIB

[75] Inventor: Lawrence Artz, Wilton, Conn.

[73] Assignee: Babystar, Brooklyn, N.Y.

[21] Appl. No.: 940,124

[22] Filed: Sep. 3, 1992

[51] Int. Cl.[5] ..... A47D 7/00

[52] U.S. Cl. ..... 5/93.1; 5/99.1

[58] Field of Search ..... 5/93.1, 99.1, 413; 52/2.11, 2.13, 2.17, 2.18, 2.19, 2.21, 2.22; D6/391, 604

[56] References Cited

U.S. PATENT DOCUMENTS

| | | | |
|---|---|---|---|
| D. 197,551 | 2/1964 | Choy . | |
| D. 276,384 | 11/1984 | Kroll . | |
| D. 315,838 | 4/1991 | Penrod . | |
| 2,644,173 | 7/1953 | James . | |
| 3,049,728 | 8/1962 | Lund | 5/99.1 |
| 3,137,870 | 6/1964 | Fink . | |
| 3,323,147 | 6/1967 | VanDean . | |
| 3,430,271 | 3/1969 | Junod-Deile . | |
| 3,457,684 | 7/1969 | Wood, Jr. | 52/2.21 |
| 3,513,489 | 5/1970 | Miller et al. . | |
| 3,619,825 | 11/1971 | Taub et al. . | |
| 3,763,506 | 10/1973 | Szego . | |
| 3,833,947 | 9/1974 | Sorensen . | |
| 4,003,098 | 1/1977 | Fink . | |
| 4,104,750 | 8/1978 | Kelter et al. . | |
| 4,531,330 | 7/1985 | Phillips | 52/2.21 |
| 4,815,153 | 3/1989 | Bleser et al. . | |
| 4,819,284 | 4/1989 | Brown | 5/99.1 |
| 4,819,389 | 4/1989 | Kihn | 52/2.21 |
| 4,827,542 | 5/1989 | Kurtenbach | 5/93.1 |

FOREIGN PATENT DOCUMENTS

| | | | |
|---|---|---|---|
| 2347526 | 4/1975 | Fed. Rep. of Germany | 5/99.1 |

*Primary Examiner*—Peter M. Cuomo
*Assistant Examiner*—Michael J. Milano
*Attorney, Agent, or Firm*—Amster, Rothstein & Ebenstein

[57] ABSTRACT

An inflatable crib includes a plurality of inflatable vertical support columns and a plurality of inflatable sidewall panels, each of the sidewall panels laterally connecting an adjacent pair of the support columns. Optionally, the crib additionally includes an inflatable bottom panel disposed adjacent to the bottom of the support columns and the sidewall panels and extending therebetween, and/or an inflatable peripheral panel disposed adjacent to the bottom of each of the support columns and the sidewall panels and extending laterally outwardly therefrom to serve as an anti-tipover bumper.

14 Claims, 5 Drawing Sheets

INFLATABLE CRIB

BACKGROUND OF THE INVENTION

The present invention relates to a crib, and more particularly to an inflatable crib affording a high level of safety.

The advantages of an inflatable crib are numerous and manifest. The deflated crib is compact and thus may be easily stored (for example, in a closet) and/or transported (for example, in a car trunk). The deflated crib is then simply removed from a closet or like storage space and easily pumped up (for example, using a foot pump) so that the visiting grandchild can be provided with a serviceable crib during the occasional visit. Similarly, during a lunch break on an all-day car trip, the deflated crib is simply removed from the car trunk and inflated to provide an enclosure for a child at a picnic location, in a restaurant or the like.

Unfortunately, the disadavantages of prior art inflatable cribs are equally numerous and manifest. Assuming that the crib defines a single inflatable chamber, it requires but a single puncture of that chamber to render the crib totally useless and permit the child to crawl or walk away from the crib. An inflatable crib is so lightweight that, if a child pulled itself upright holding on to the side of the crib and then leaned on that side of the crib, it might easily cause the crib to tip over, possibly injuring the child during the tipover and at the very least allowing the child to leave the crib once it was turned over. If unapertured, the sidewalls of the crib interfere with the free flow of fresh air to the child. If nontransparent, the sidewalls interfere with proper illumination of the crib. Most importantly, however, if the crib deflates as the result of a puncture, the deflated sidewalls of the crib could collapse inwardly so as to cover and suffocate the child within the crib.

Accordingly, it is an overall object of the present invention to provide an inflatable crib affording a variety of different safety features.

Another object is to provide such a crib having independently inflatable and deflatable vertical support columns to prevent collapse of deflated crib sidewalls on the child.

Yet another object is to provide such a crib having an anti-tipover bumper.

A further object is to provide such a crib which facilitates the flow of light and air therethrough.

It is also an object to provide such a crib which is easily inflatable and deflatable.

SUMMARY OF THE INVENTION

It has now been found that the above and related objects of the present invention are obtained in an inflatable crib. The inflatable crib comprises a plurality of inflatable vertical support columns and a plurality of inflatable sidewall panels, each of the sidewall panels laterally connecting an adjacent pair of the support columns.

In a preferred embodiment, an inflatable bottom panel is disposed adjacent to the bottom of the support columns and the sidewall panels and extends therebetween. An inflatable peripheral panel is also disposed adjacent to the bottom of each of the support columns and sidewall panels (and any bottom panel) and extends laterally outwardly therefrom to serve as an anti-tipover bumper. The peripheral panel has at least one laterally concave edge, with the ends of the concave edge adjacent the support columns extending laterally outwardly therefrom a substantial distance to serve as an anti-tipover bumper while a central portion of said concave edge connected to said ends does not extend laterally outwardly as far as said ends, thereby to permit a closer approach to the crib center at the concave ends. All of the sidewall panels are in gaseous communication and are commonly inflatable and deflatable. The bottom panel and the peripheral panel are in gaseous communication with each other (and optionally with the sidewall panels as well) and are commonly inflatable and deflatable. The support columns are in gaseous communication with each other and with the sidewall and bottom panels only through one-way inflation-only valves, so that the support columns are commonly inflatable but only separately and independently deflatable.

The crib is preferably of rectangular configuration and has four of the support columns, one in each corner, and four of the sidewall panels Each of the sidewall panels defines the periphery of an aperture extending therethrough, and an at least partially transparent window is disposed in each of the apertures. Each of the support columns defines at the top thereof a relatively more flexible pillowed portion.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
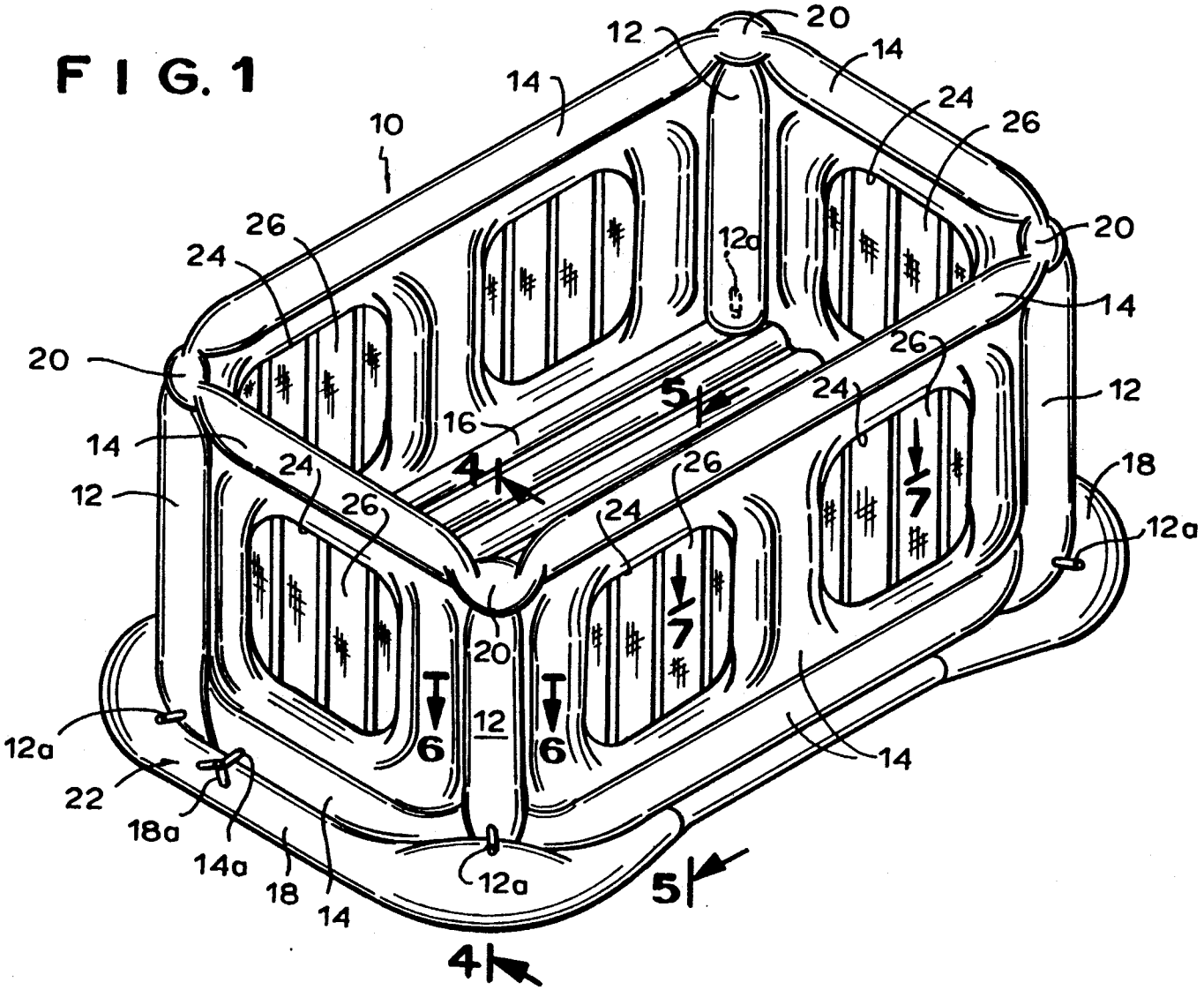
FIG. 1 is an isometric view of an inflated crib according to the present invention.

Referring now to the drawing and in particular to FIG. 1 thereof, therein illustrated is an inflatable crib according to the present invention, generally designated by the reference numeral 10. The inflatable crib 10 comprises, at a minimum, a plurality of inflatable vertical support columns 12 and a plurality of inflatable sidewall panels 14. Each of the sidewall panels 14 laterally connects an adjacent pair of the support columns 12.

Preferably, the crib 10 additionally includes an inflatable bottom panel 16 disposed adjacent and connected to the bottoms of the support columns 12 and the sidewall panels 14 and extending therebetween to completely cover the enclosed space at the bottom of the crib 10. Optionally, the crib 10 further includes an inflatable peripheral panel 18 disposed adjacent and connected to the bottoms of each of the support columns 12, sidewall panels 14, and any bottom panel 16 and extending laterally outwardly therefrom to serve as an anti-tipover bumper.

Referring now to FIGS. 3–7 as well, each of the support columns 12 is independently deflatable only through its own respective deflation valve **12*a*, but is in gaseous communication through a one-way inflation-only valve 12b (see FIG. 6) with all other support columns 12 and with the sidewall and bottom panels 14, 16 for common inflation. The valve 12b may simply be a relatively long, collapsible tube extending from a sidewall panel 14 into the support column 12 and adapted to collapse or close when the support column internal pressure exceeds the sidewall panel internal pressure. By way of contrast, the various sidewall panels 14 and the bottom panel 16 are in gaseous communication with each other (see FIG. 5) and are commonly inflatable and deflatable through a single valve 14a. The support columns 12 do not extend all the way to the top of the crib 10, so that the sidewall panels 14 include a segment 20 above each of the support columns 12 in order to provide gaseous communication between the adjacent sidewall panels 14. Where present, the bottom panel 16 is also in gaseous communication with, and commonly inflatable and deflatable with, the sidewall panels 14**.

Preferably the material defining each segment 20 is overcut (i.e., cut to dimensions greater than those required to define a smooth segment) so that each segment 20 defines creases and crevasses along its top and sides and feels softer than the adjacent sidewall panels 14 or support columns 12, more like a pillow or cushion than a structural member. It is theorized that the relative softness of the pillowed corners 20 results from the provision of an elongaged chamber which is easily buckled to break the continuity of air flow, volume and pressure. Optionally, the various panels 14, 16, 18 may each be of a unitary construction defining only a single chamber therewithin or comprised of a plurality of sub-chambers in gaseous communication with each other, commonly inflatable and deflatable.

Figure 4:
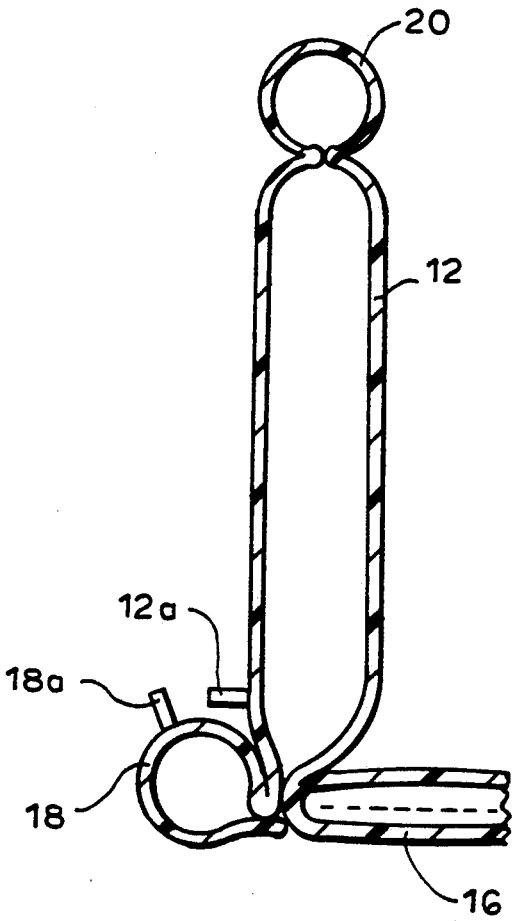
FIGS. 4, 5, 6 and 7 are fragmentary sectional views taken along the lines 4—4, 5—5 6—6 and 7—7, respectively, of FIG. 1.
Figure 5:
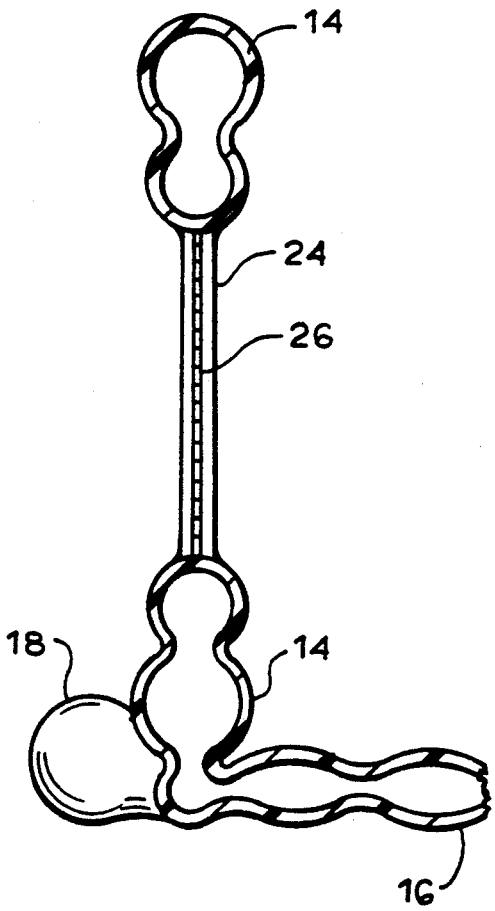
Figure 6:
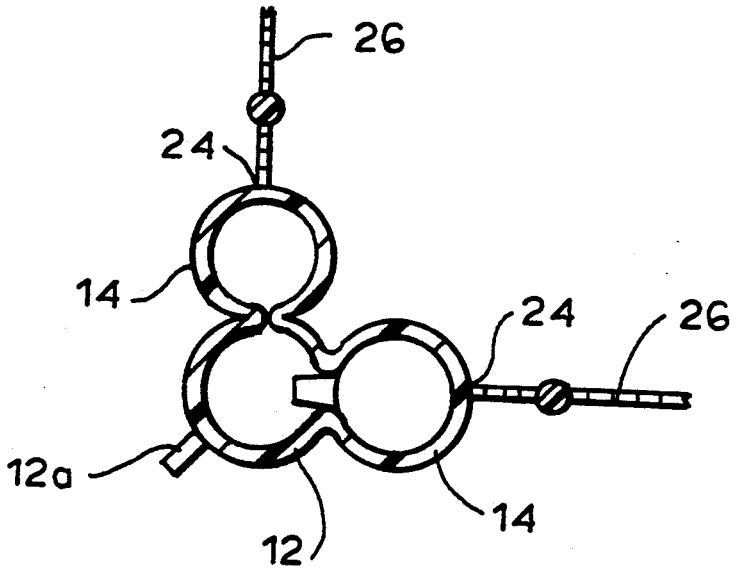

As illustrated in FIGS. 1 and 4–5, the sidewall panels 14 and bottom panel 16 are commonly inflated (with support columns 12) and deflated through a single valve 14a, and the peripheral panel 18 is inflated and deflated through a single valve 18a, with the valves 14a, 18a being commonly connected to a single relief or safety valve 22 to prevent overinflation of the sidewall, bottom and peripheral panels 14, 16, 18 and support columns 12. As inflation/deflation valves and relief or safety valves are well known, it is not deemed necessary to set forth further details thereof herein.

Figure 7:
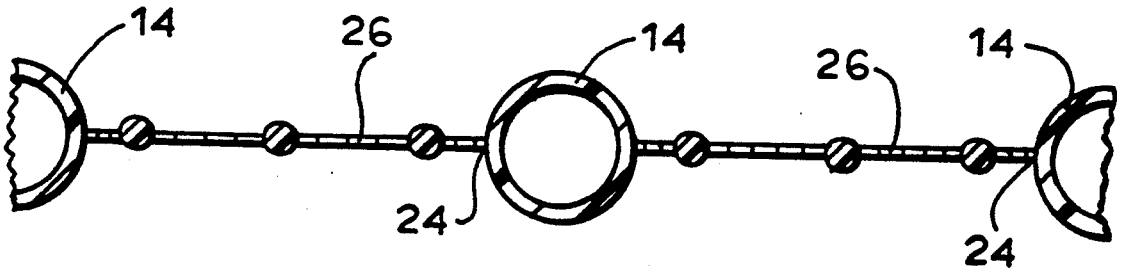

In a preferred embodiment of the present invention, as illustrated in FIGS. 1, 5 and 7, each of the sidewall panels 14 defines the periphery of at least one aperture 24 therethrough, the number of apertures 24 of a given sidewall panel 14 being variable. Preferably a mesh 26 permitting passage of both air and light therethrough is disposed in each of the apertures 24, the mesh 26 being formed of a material (e.g., cotton or polyester) sufficiently strong to withstand tearing by a child desirous of leaving the crib 10. The mesh is preferably translucent or transparent, like a window.

The crib 10 may be of any desired configuration. Where the crib 10 is polygonal, generally the number of support columns 12 and sidewalls panels 14 are equal. Thus, the illustrated crib is of a rectangular configuration and has four support columns 12, one in each corner, and four sidewall panels 14, each of the end sidewall panels 14 defining a single aperture 24, and each of the side sidewall panels 14 defining two of the apertures 24. If desired, the crib 10 may be of circular configuration with the support columns 12 being disposed at regularly spaced intervals along the circumference of the crib.

While a unitary peripheral panel 18 has been illustrated, clearly the peripheral panel 18 may alternatively be formed of a plurality of panels equal in number to the plurality of sidewall panels 14, each peripheral panel being in gaseous communication and common inflatable and deflatable with either its respective sidewall panel 14 or the bottom panel 16.

Inflation of the deflated crib is simple and may be performed by mouth, but preferably using a hand pump, a foot pump, an electric pump, or the like. Common inflation is possible for all elements (including each of the four illustrated support columns) using the common safety valve 22 for the valves 14a and 18a and the one-way inflation-only valve 12b. To deflate the crib, the support columns 12 are deflated using their respective one-way deflation valves 12a, while the sidewall panels 14 and the bottom panel 16 are deflated using their common valve 14a, and the peripheral panel 18 is deflated using its valve 18a. Deflation of the inflated crib may be performed in any order, either using a deflation pump or simply opening the valves 12a, 14a, 18a and squeezing the several support columns 12 and the various panels 14, 16, 18 as necessary to drive the air out of them. The deflated crib may then be compactly folded into a generally flat, compact mass lending itself to easy storage.

Figure 2:
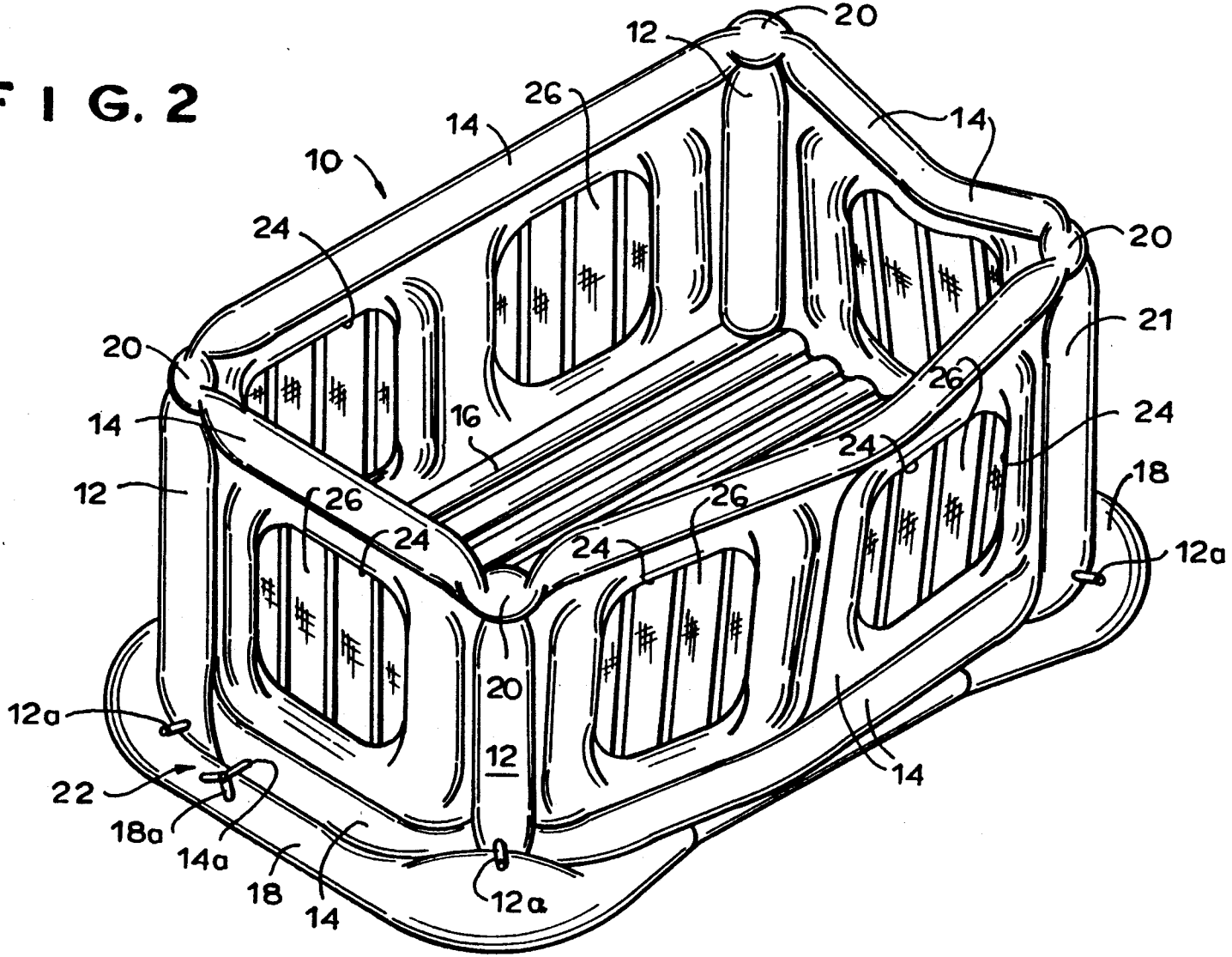
FIG. 2 is an isometric view of the crib after partial deflation, as by an accidental puncture.
Figure 3:
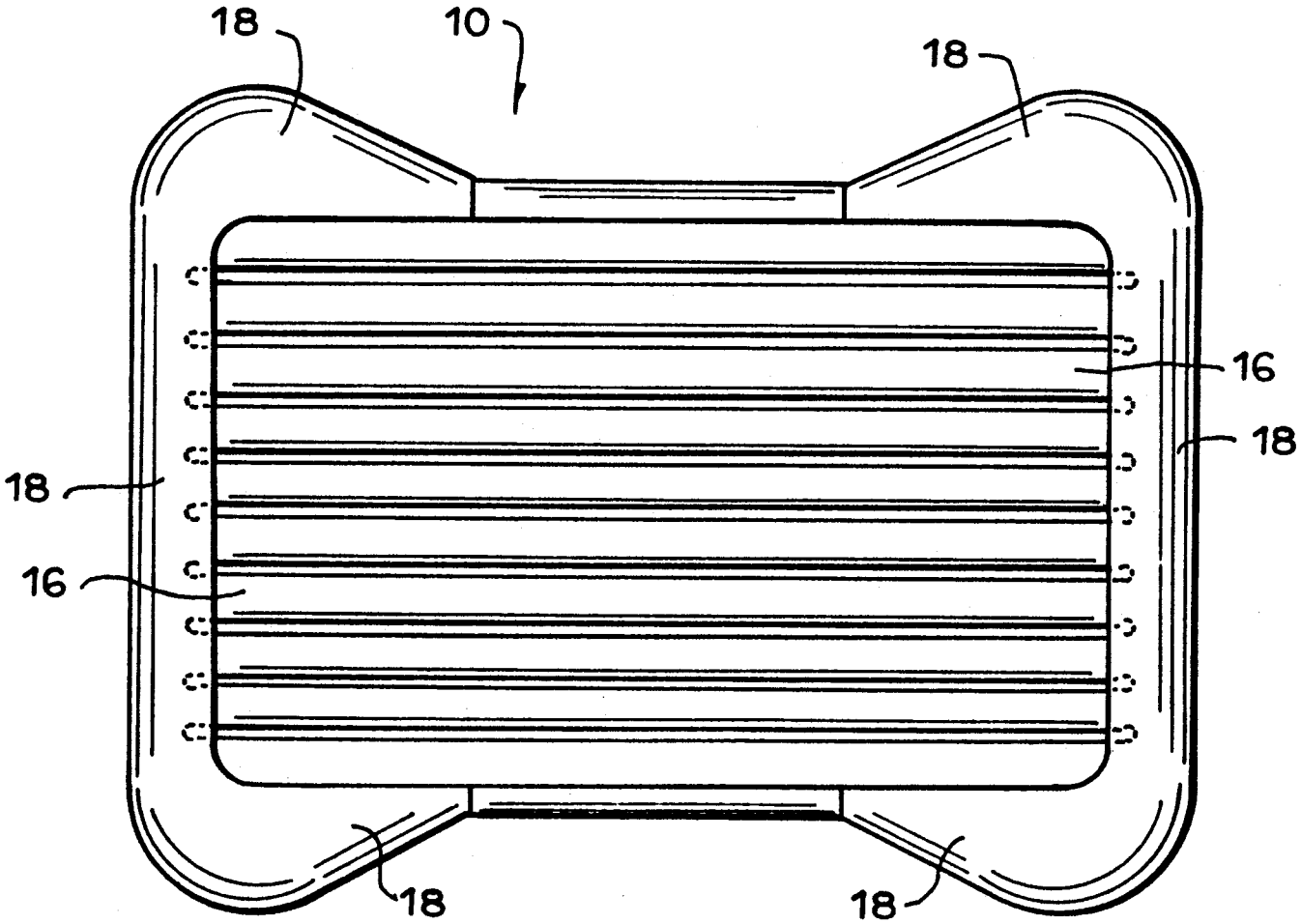
FIG. 3 is a bottom plan view of the crib.

It will be appreciated that, as illustrated in FIG. 2, when there has been a loss of pressure in one or even two of the sidewall panels 14, the separate and distinct support columns 12 maintain their integrity and keep the sidewall panels 14 in a somewhat supported state so that they cannot fall on and suffocate the child within the crib. Similarly, if one of the support columns 12 is punctured and collapses, the remaining inflated support columns 12 are sufficient to maintain the sidewall panels 14 somewhat erect so that they do not collapse upon and suffocate the child within the crib 10.

The crib 10 may be formed of any of a variety of materials lending themselves to a lightweight, flexible (i.e., foldable) airtight construction—for example, plastic, rubber, or the like. Although the mesh 26 need not be airtight, it is conveniently formed of the same type of material. The material is additionally selected for ease of sealing the various portions thereof together (for example, either to form an airtight chamber or simply a physical connection between various components of the crib). To this end, thermally or ultrasonically sealable plastics are preferred. This enables easy sealing of the various components together, for example, a pair of sidewall panels 14, a support column 12 and the bottom and peripheral panels 16, 18 adjacent each corner of the crib 10.

To summarize, the present invention provides an inflatable crib affording a variety of different safety features. The crib has independently inflatable and deflatable vertical support columns to prevent collapse of deflated crib sidewalls on the child, an anti-tipover peripheral bumper, and sidewall panel apertures to facilitate the flow of light and air therethrough. The crib is easily inflatable and deflatable between a compact folded orientation and an inflated use orientation.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. An inflatable crib comprising:

(A) a plurality of inflatable vertical support columns, and (B) a plurality of inflatable sidewall panels, each of said sidewall panels laterally connecting an adjacent pair of said support columns, said support columns being in gaseous communications with said sidewall panels, and hence each other, only through one-way inflation-only valves so that said support columns are each commonly inflatable, but only independently deflatable.

2. The crib of claim 1 additionally including an inflatable peripheral panel disposed adjacent to a bottom of each of said support columns and sidewall panels and extending laterally outwardly therefrom to serve as an anti-tipover bumper.

3. The crib of claim 2 wherein said peripheral panel has at least one laterally concave edge with the ends of said concave edge adjacent said support columns extending laterally outwardly therefrom a substantial distance to serve as an anti-tipover bumper while a central portion of said concave edge does not extend laterally outwardly as far as said ends, thereof to permit a closer approach to the crib center at said central portion.

4. The crib of claim 1 additionally including an inflatable bottom panel disposed adjacent to a bottom of said support columns and said sidewall panels and extending therebetween.

5. The crib of claim 4 additionally including an inflatable peripheral panel connected to each of said support columns, sidewall panels and said bottom panel and extending laterally outwardly therefrom to serve as an anti-tipover bumper.

6. The crib of claim 5 wherein said bottom panel and said peripheral panel are in gaseous communication and are commonly inflatable and deflatable.

7. The crib of claim 5 wherein said bottom panel, said sidewall panels and said peripheral panel are in gaseous communication and are commonly inflatable and deflatable.

8. The crib of claim 1 wherein all of said sidewall panels are in gaseous communication and are commonly inflatable and deflatable.

9. The crib of claim 1 wherein each of said sidewall panels defines the periphery of an aperture extending therethrough.

10. The crib of claim 9 wherein an at least partially transparent window is disposed in each of said apertures.

11. The crib of claim 1 wherein said crib is of rectangular configuration and has four of said support columns, one in each corner, and four of said sidewall panels.

12. The crib of claim 1 wherein each of said support columns defines at the top thereof relatively a more flexible pillowed portion.

13. An inflatable crib comprising:

(A) a plurality of inflatable vertical support columns;

(B) a plurality of inflatable sidewall panels, each of said sidewall panels defining the periphery of an aperture extending therethrough and laterally connecting an adjacent pair of said support columns;

(C) an inflatable bottom panel disposed adjacent to a bottom of said support columns and said sidewall panels and extending therebetween; and (D) an inflatable peripheral panel disposed adjacent to the bottom of each of said support columns, sidewall panels and said bottom panel and extending laterally outwardly therefrom to serve as an anti-tipover bumper;

said bottom panel, said sidewall panels and said peripheral panel being in gaseous communication and commonly inflatable and deflatable, said support columns being in gaseous communication with said sidewall and bottom panels, and hence each other, only through one-way inflation-only valves so that said support columns are commonly inflatable but only independently deflatable.

14. An inflatable crib comprising:

(A) a plurality of inflatable vertical support columns, each of said support columns defining at the top thereof an overcut pillowed portion which defines creases and crevasses and is relatively more flexible and softer than the remainder of said support column; and (B) a plurality of inflatable sidewall panels, each of said sidewall panels laterally connecting an adjacent pair of said support columns.

* * * * *